United States Patent [19]

Ferrell et al.

[11] Patent Number: 4,534,752

[45] Date of Patent: Aug. 13, 1985

[54] APPARATUS AND METHOD FOR SECURING TOP ENDS OF SACK GUSSETS

[75] Inventors: Robert A. Ferrell, Shelbyville; Richard G. Rebber, Flat Rock, both of Ind.

[73] Assignee: KCL Corporation, Shelbyville, Ind.

[21] Appl. No.: 599,216

[22] Filed: Apr. 12, 1984

Related U.S. Application Data

[63] Continuation of Ser. No. 383,986, Jun. 1, 1982, abandoned.

[51] Int. Cl.[3] ..... B31B 1/62; B31B 1/84

[52] U.S. Cl. ..... 493/213; 493/248; 493/264; 493/267; 493/333; 493/929

[58] Field of Search ..... 493/213, 212, 239, 264, 493/267, 927, 929, 248, 333, 331

[56] References Cited

U.S. PATENT DOCUMENTS

| | | | |
|---|---|---|---|
| 2,041,375 | 5/1936 | Schwerler | 383/78 X |
| 2,409,621 | 10/1946 | Geimer et al. | 383/7 X |
| 2,788,720 | 4/1957 | Browning | 493/264 X |
| 3,203,621 | 8/1965 | Wright | 229/62 |
| 3,350,859 | 11/1967 | Fesco | 383/120 |
| 3,716,181 | 2/1973 | Terzuoli | 229/62 |
| 3,755,993 | 9/1973 | Cote | 229/62 |
| 4,241,865 | 12/1980 | Ferrell | 229/62 |
| 4,261,254 | 4/1981 | Nowacki | 493/7 |
| 4,337,889 | 7/1982 | Moertel | 229/62 |

*Primary Examiner*—James F. Coan

*Attorney, Agent, or Firm*—Hill, Van Santen, Steadman & Simpson

[57] ABSTRACT

The top end of a side gusset of a reclosable sack is securely closed as by means of spots of adhesive on and between the infolded gusset walls, leaving the bag walls free to spread relative to the gusset, and leaving the remainder of the gusset to its opposite end free to expand. A method and apparatus are provided for making the sacks.

15 Claims, 10 Drawing Figures

FIG. 1
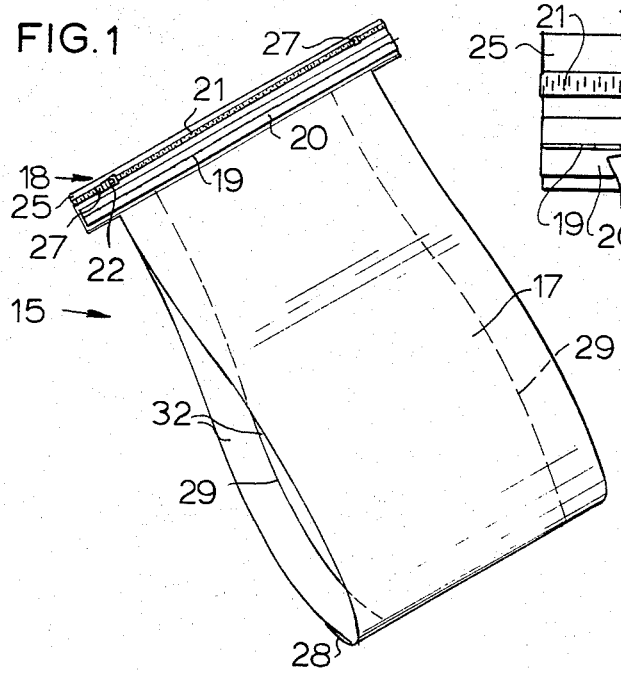
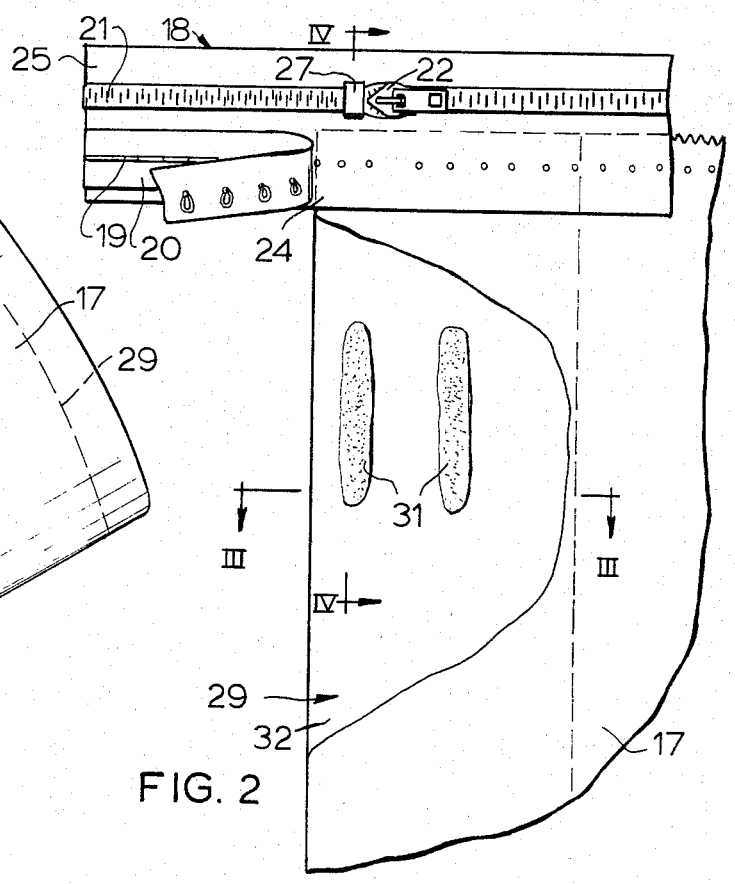
FIG. 2
FIG. 3
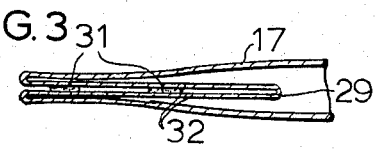
FIG. 5
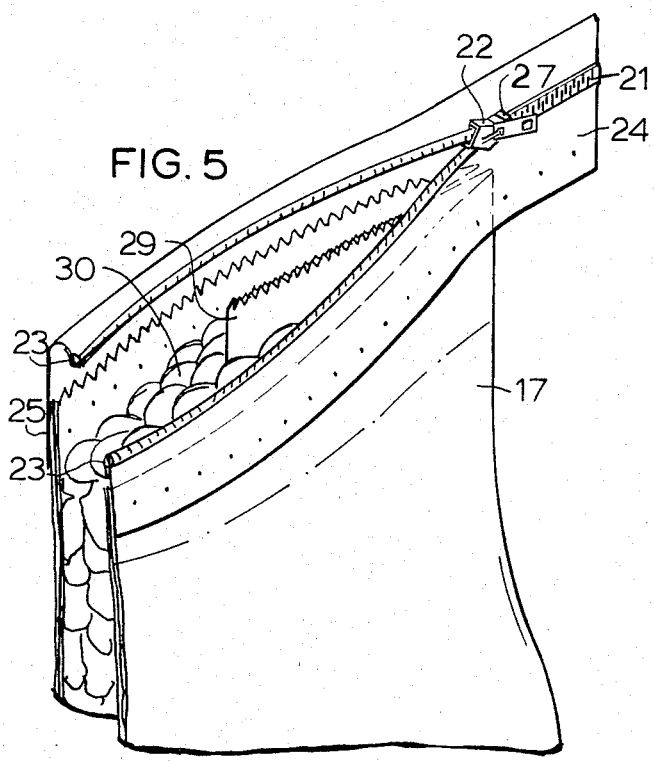
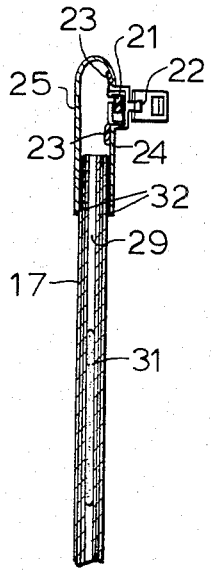
FIG. 4

FIG. 6
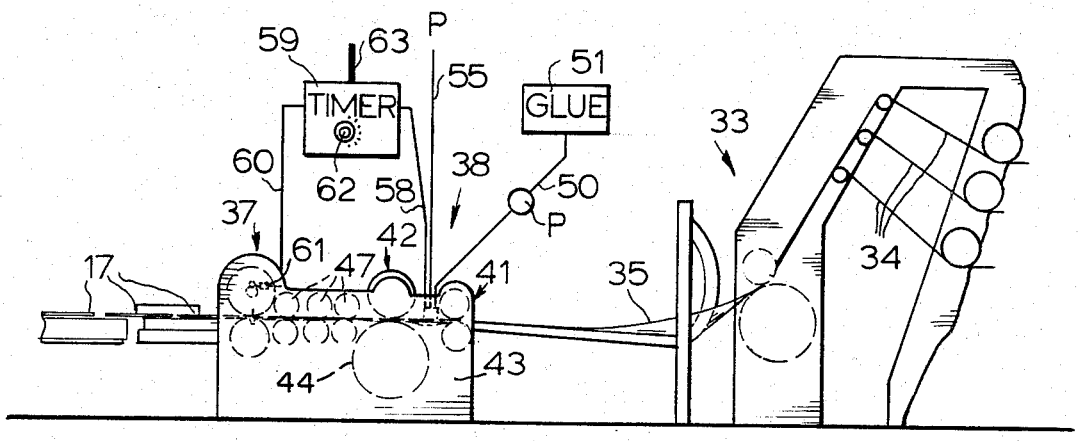
FIG.7
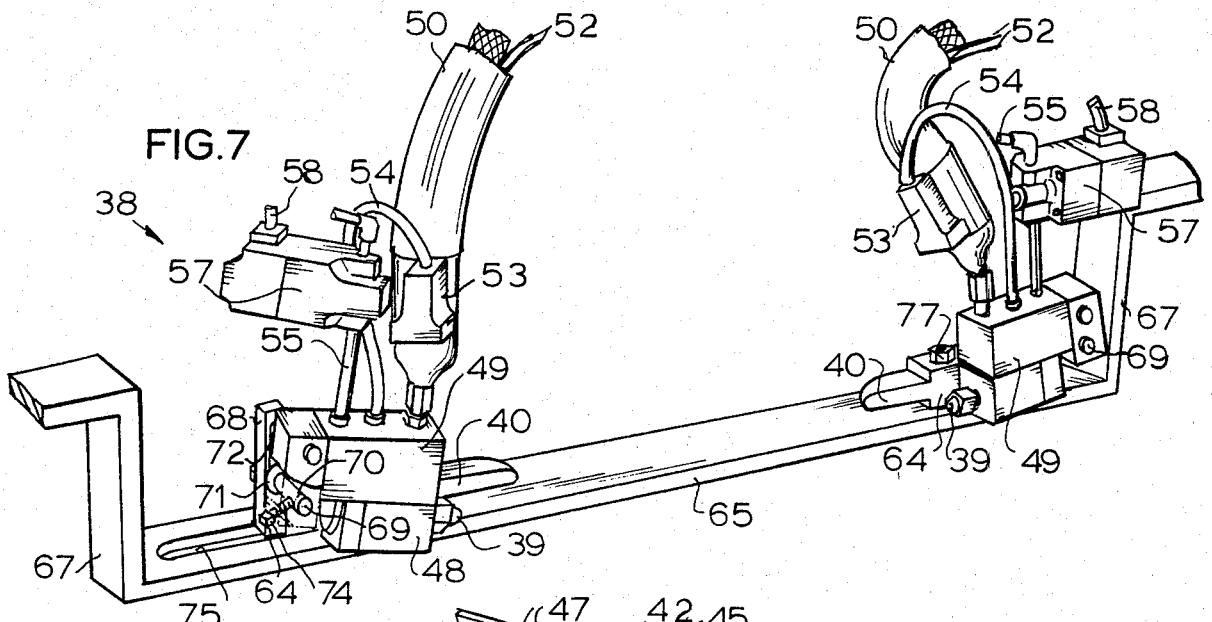
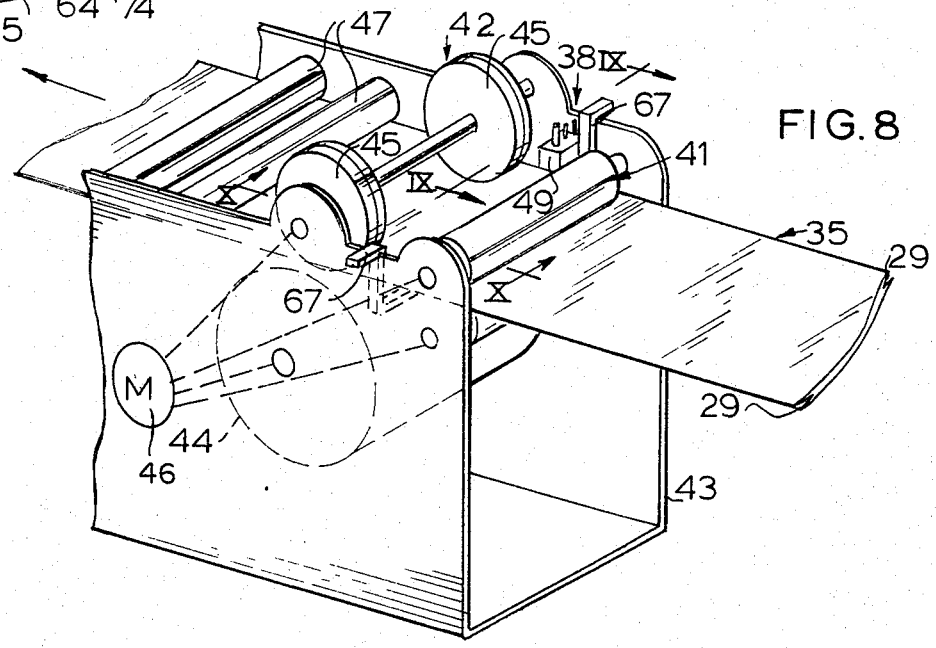
FIG. 8

APPARATUS AND METHOD FOR SECURING TOP ENDS OF SACK GUSSETS

This application is a continuation of application Ser. No. 383,986, filed June 1, 1982, now abandoned.

This invention relates to the art of reclosable bags or sacks, and is more particularly concerned with sacks of the type which are generally made from paper and adapted for relatively large volume contents such as pet foods, bird seed, garden and lawn fertilizer, charcoal briquets, and the like. Sacks of the type to which the present invention is particularly directed may be of the kind disclosed in U.S. Pat. No. 4,241,865, and assigned to the same assignee as the present application. A unique feature of the patent disclosure is the provision on the upper or contents access or discharge ends of the sacks of a primary non-reclosable separable closure fastener and a secondary reclosable fastener. The non-reclosable fastener comprises a chain stitched rip strip or tape which maintains the sack closed in a tamper-proof manner. After the non-reclosable fastener is removed, access into the sack may be had by opening the reclosable fastener which is equipped with a zipper.

Sacks having the indicated closure arrangement are adapted to be handled or stacked, before filling, in a flat condition, that is in the form of collapsed, flat tube. For this purpose, the sides of the sacks are folded either along simple one bend folds, or they may be gusset folded wherein one or more of the side edges of the sack may be reentrantly folded in an accordion pleat manner, whereby to afford expansible bag side structure.

Where a sack has simple one bend fold sides, the reclosable fastener when closed adequately retains the bag top or mouth closed against spillage because the opposite ends of the closure, being secured across the upper ends of the side edges of the sack substantially avoid escape of contents past the ends of the closed closure. Entrance of vermim into the sack through the ends of the closed closure is also substantially precluded. However, where this type of reclosable closure is employed on a gusseted sack, a problem has been experienced in that the upper end of the gusset tends to expand and thus provide a sufficient opening for possible unintended escape of content, or for easy entry of vermin. The present invention alleviates the problem.

Accordingly, it is an important object of the present invention to provide a new and improved side gussetted, reclosable fastener equipped sack having novel securement of the gusset end adjacent to the top of the sack.

Another object of the invention is to provide a new and improved method of making side gussetted, reclosable fastener equipped sacks.

A further object of the invention is to provide new and improved apparatus for making side gussetted sacks adapted to carry reclosable closure means across the tops and for effecting securement of the gusset ends adjacent to a bag top end of each sack blank.

There is provided by the present invention a sack having an openable top for access into the sack, and reclosable closure means across said top, and comprising an expansion gusset on at least one side of said sack, and having an end adjacent to said top; and securing means for holding said gusset end closed but permitting expansion of the remainder of the gusset and access into the interior of the sack through said openable top under the control of said reclosable closure means.

This invention also provides a method of making a sack having an openable top for access into the sack, and reclosable closure means across said top, the method comprising providing an expansion gusset on at least one side of said sack, and having an end adjacent to said top; and providing securing means for holding said gusset end closed but permitting expansion of the remainder of the gusset and access to the interior of the sack through said openable top under the control of said reclosable closure means.

In a further aspect of the invention, there is provided in apparatus for making sacks having openable tops for access into the sacks, and each sack adapted to carry reclosable closure means across its open top, means for transporting along a given path sack blanks each having an expansion gusset on at least one side and with an end of the gusset adjacent to a bag top end of the sack blank, and means located along said path for applying securing means selectively to said gusset end of each sack blank but leaving the remainder of the gusset of each sack blank freely expansible and leaving the openable top of each sack blank free for opening under reclosable closure means control.

Other objects, features and advantages of the invention will be readily apparent from the following description of certain representative embodiments thereof, taken in conjunction with the accompanying drawings, although variations and modifications may be effected without departing from the spirit and scope of the novel concepts embodied in the disclosure and in which:

FIG. 1 is an isometric view of a sack embodying the invention;

FIG. 2 is an enlarged fragmentary detail view of a top portion of the sack and with a part partially broken away to reveal a detail of the disclosure;

FIG. 3 is a horizontal section detail view taken substantially along the line III—III of FIG. 2;

FIG. 4 is a vertical sectional detail view taken substantially along the line IV—IV of FIG. 2;

FIG. 5 is a fragmentary isometric view showing the sack top with the reclosable closure means open;

FIG. 6 is a schematic illustration of sack blank making apparatus embodying the invention;

FIG. 7 is a perspective view of gusset separating and adhesive applying mechanism employed in the apparatus of FIG. 6;

FIG. 8 is a more or less schematic perspective view of the gusset securing station of the apparatus;

Figure 9:
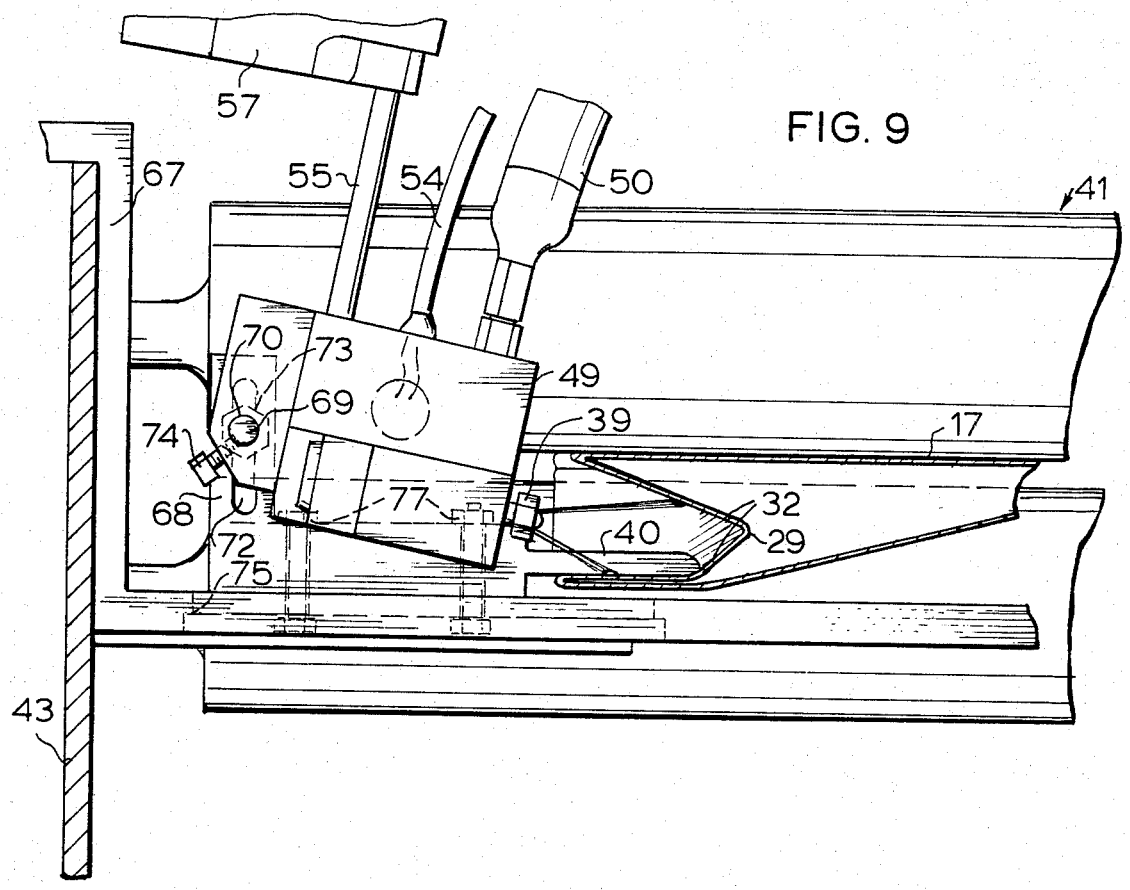
FIG. 9 is an enlarged fragmentary vertical sectional detail view taken substantially along the line IX—IX of FIG. 8.

A sack 15 (FIGS. 1–5) in accordance with the present invention, comprises a body 17 which may be made of any suitable material, but according to a preferred construction comprises multi-ply paper for heavy duty use. The body 17 is of tubular form and adapted when unfilled to lie in a collapsed flattened condition wherein opposite bag walls lie substantially on one another, thereby facilitating stacking and storage of the empty sacks.

Each sack 15 has an openable top for access into the sack, and desirably a reclosable fastener device closure 18 secured across the top and embodying a structure in accordance with the aforesaid U.S. Pat. No. 4,241,865. In addition, there is preferably provided a primary non-reclosable stitched separable closure fastener 19 comprising a line of chain stitches securing the bag walls tightly together until the stitching is released. A rip tape 20 attached by means of the stitching 19 is adapted to be pulled when it is desired to open the chain stitch fastener, whereupon the reclosable fastener 18 across the upper or mouth end of the sack is adapted to serve as a secondary closure control to access into the sack. The reclosable closure 18 comprises a zipper 21 arranged to be opened and closed as by means of a conventional slider 22 and provided with stringers fastened in any suitable manner such as by stitching or adhesively to respectively an anchoring strip 24 adhesively secured to the upper margin of the front wall of the sack and to a turned over upper portion of a second anchoring closure strip 25 which is adhesively secured to the upper margin of the back wall of the sack. To prevent overrunning of the slider 22 at opposite ends of its closing and opening range, respective spaced terminal stops 27 are provided on the zipper. Through this arrangement, a tamper-proof closure for the sack mouth is provided by the stitch fastener 19, and after this fastener has been removed as indicated in FIGS. 2, 4 and 5, access into the sack may be had selectively by opening the zipper 21.

Until the sack 15 is filled, the lower or bottom end of the sack body 17 is left open for filling purposes. After filling, a bottom closure is fixed across the bottom which desirably comprises a turned over folded closure 28 which may be secured in any desirable manner, such as adhesively, by stapling, or by stitching.

Pursuant to the aforesaid U.S. Pat. No. 4,241,865, sacks of the kind described may be provided with simple folded side edges or with longitudinal gussets, and it is to the gussetted type of this kind of sack that the present invention is primarily directed. To this end, the sack body 17 has a reentrant or inturned expansion gusset 29 along at least one side of the sack and extending throughout the length of the sack and with an end adjacent to the top of the sack, as best visualized in FIG. 5. For best results, both sides of the sack body 17 are provided with one of the gussets 29. This facilitates (FIG. 1) expansion of the sack body 17 when filled with contents, such as indicated at 30 in FIG. 5. Inasmuch as the primary closure 19 extends across and secures the upper end portions of the gussets 29, as well as the walls of the sack body 17, the end portions of the gussets cannot expand or open up until the chain stitched fastener 19 is removed. Thus, until the primary closure is removed, there is positive retention of contents within the bag regardless of how the bag is manipulated. However, it has been found that when the primary closure is removed, there has been a contents escape route through the sack mouth ends of the gussets 29 even when the zipper 21 is closed, because as best visualized in FIGS. 4 and 5, the zipper closure assembly is located above the upper or mouth end of the sack wall 17 and in an unrestrained condition, the upper gusset ends afford a passage when expanded communicating with the space within the secondary fastener assembly comprising the zipper 21 and the anchoring strips 24 and 25. Such access passage is undesirable especially for small particulate contents of a particle size on the order of birdseed, and which may also be found in animal feed and the like. Also, such gusset passage access affords convenient access for vermin, such as mice. It is to the alleviation of this problem that the present invention is primarily directed.

To this end, securing means are provided for holding the gusset ends closed but permitting expansion of the remainder of the gussets, and access into the interior of the sack through the openable top under the control of the reclosable closure means comprising the zipper 21. Conveniently and efficiently, the gusset securing means comprises adhesive (FIGS. 2–4) securing opposed walls 32 of each of the gussets 29 fixedly together adjacent to the upper ends of the gussets, while leaving the remainder of the gussets free for expansion, and also leaving the sack walls free to expand away from the secured portions of the gussets. In a desirable arrangement, where the sacks 15 are about 30 inches long, 15 inches wide and with the walls of the gussets about $2\frac{1}{2}$ inches wide, the adhesive 31 may be applied in spaced spots elongated in the direction of the length of the gusset walls 32 and spaced from the adjacent top ends of the gusset. For example, in a $2\frac{1}{2}$ inch wide gusset, the spots of adhesive 31 may be from $\frac{1}{4}$ to $\frac{1}{2}$ inch wide, approximately 1 to $1\frac{1}{2}$ inches in length, spaced from 1 to 2 inches from the top ends of the gussets, spaced about $\frac{1}{2}$ inch part and with the outermost of the adhesive spots about $\frac{1}{4}$ inch from the edge of the sack body. Not only does this afford a satisfactory closure securement of the upper end portions of the gussets, but in the unopened condition of the sack top closures, avoids any gusset expansion strain on the closures.

A method and apparatus for making the sacks 15 are depicted in FIGS. 6—10. Sack blanks are produced in a continuous tub length by means of a tubing machine 33 of any preferred construction. Such machines are well known and will produce tube lengths for paper sacks having any desired number of plies. In a three ply sack tube, three continuous sheets 34 of the desired sack material or materials are fed into and through the machine, shaped into gussetted tubular form about one another and then advanced as a collapsed tube length 35 along a given path to a rotary cut-off bar assembly 37 where the continuous, collapsed sack tube 35 is severed into individual lengths to provide the sack bodies 17.

At a suitable location intermediate the tubing machine 33 and the cut-off device 37, means 38 are provided for applying the gusset securing adhesive 31 selectively to the gussets 29 along the edges of the collapsed continuous sack tube 35 so that the adhesive will be located at the proper places along the gussets 29 for the individual sack blanks.

Figure 10:
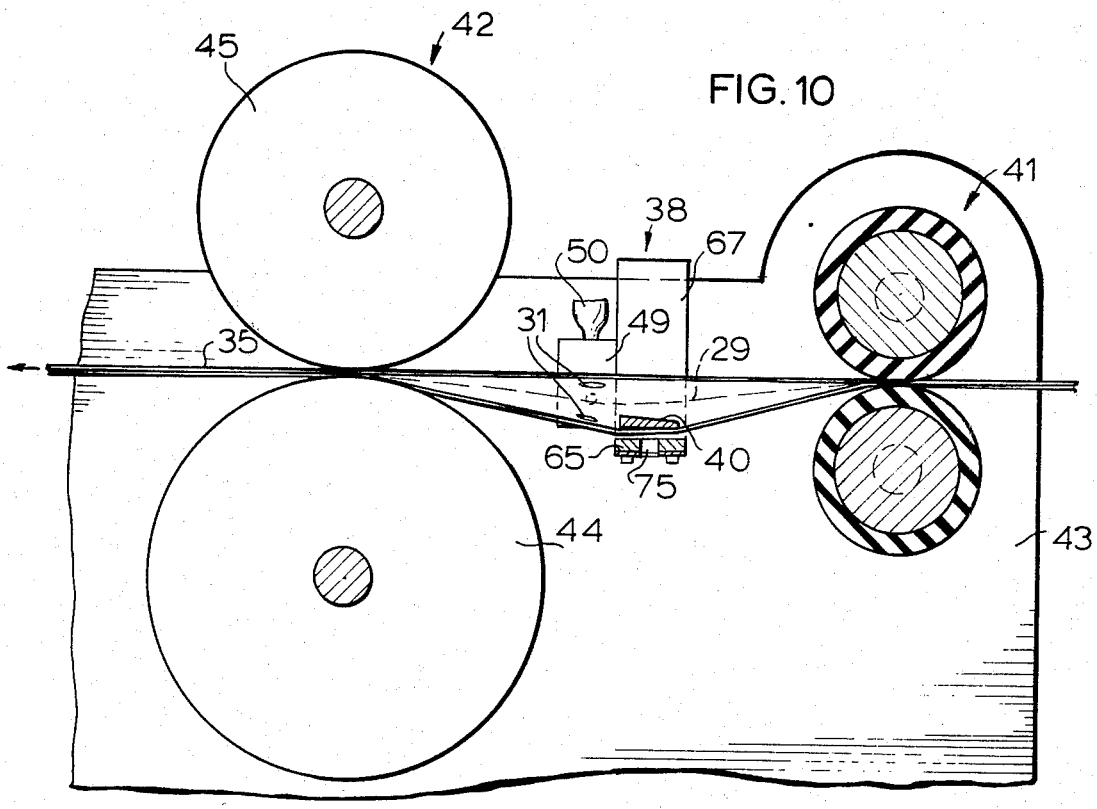
FIG. 10 is an enlarged fragmentary sectional detail view taken substantially along the line X—X of FIG. 8.

Desirably, the adhesive applicator means comprises a pair of dual orifice nozzles 39 located in association with respective gusset spreader fingers 40 at the opposite sides of the path along which the sack blank tube 35 runs. As best seen in FIGS. 9 and 10, the nozzle 39 and the spreader fingers 40 function at an elevation sufficiently below the normal plane of travel of the collapsed tube 35 so that the fingers will pull the lower walls 32 of the respective gussets 29 downwardly, thus spreading the gusset walls 32 sufficiently to receive, respectively, the adhesive from two separate jet streams directed by each nozzle 39. The jet streams deposit adhesive on the respective gusset walls 32 at the correct places so that when the gusset walls return to collapsed condition downstream from the point of adhesive application, the adhesive spots 31 (FIG. 2) will be transversely offset from one another.

To facilitate action of the spreader fingers 40 and the nozzles 39, the sack blank tube 35 is caused to run at a desired elevation in its path between spaced sets of driving rolls 41 and 42, mounted on a frame or stand 43 and driven in unison by suitable power means, such as a motor 46. By preference, the frame or stand 43 also supports the cut-off device 37 located downstream from the adhesive applicator 38. In this instance, the driving rolls 41 are located upstream from the applicator 38 and may be solid rubber covered rolls having suitable journals rotatably supported by the stand 43. The rolls 42, downstream from the applicator 38, are combined driving and pressure rolls comprising a lower pressure roll 44 and respective axially spaced upper pressure rolls 45 having their perimeters equipped to engage the gusset margins of the sack blank tube 35 downstream from the applicator 38 for applying squeezing pressure to the gussets 29 and in particular, those areas of the gussets 29 to which the adhesive spots 31 have been applied. Downstream from the pressure rolls 42 additional sets of pressure rolls 47 are desirably located to maintain squeezing pressure at least on the gusset margins of the sack blank tube strip 35 for a time interval of travel of the tube strip to assure setting of the adhesive sufficiently to avoid separation after the tube strip has been separated into the individual bag body sections 17.

In a preferred arrangement, the adhesive employed is a hot melt glue. For this purpose, the applicator nozzles 39 may be parts of hot melt automatic glue guns commercially available, such as from Nordson Corporation of Amhurst, Ohio. Each of the glue guns comprises an extrusion module 48 carried by a service block 49. Hot melt glue is supplied to the nozzle 39 in each instance through the module 48 and the service block 49 by way of a heated duct 50 from a hot melted glue source 51. The glue duct 50 may be of the insulated type having a wire braid heating element. Electrical wiring 52 runs along the hose and is connected through a connector housing 53 and a cordset 54 with a cartridge type heating element (not shown) within the service block 49.

For controlling selective application (squirting) of the glue from the nozzle 39 of each of the applicator units, an air actuated shut off plunger and piston (not shown) within the module 48 is adapted to be operated automatically in coordinated sequence with operation of the cut-off device 37. For this purpose, compressed air supplied under suitable pump pressure through an air duct 55 is controlled by means such as a solenoid 57 operatively connected by lead means 58 with a timer 59 connected by lead means 60 to a sensor such as an electric eye or the like 61 which provides signals timed with operation of the cutoff device 37. The timer 59 is provided with means 62 for adjusting the timer for coordinating glue application with selected lengths of sack blanks 17. Lead means 63 supply power to the timing system through the timer 59.

Mounting of each of the glue applicator units is adapted to be effected adjustably by means of respective mounting blocks 64 carried by a mounting bracket 65 having at its opposite ends angular attachment arms 67 by which the assembly is adapted to be mounted on the stand 43 as a self-contained assembly that may be mounted and removed as desired. In a preferred construction, each of the spreader fingers 40 is carried as part of the associated block 64. Each of the blocks 64 in addition has an upright vertically slotted arm 68 to which the service block 49 is adjustably attached by means of a rod 69 extending through a rod hole 70 and having a shoulder 71 engaging a side of the arm 68 while a threaded extension extends through a vertical adjustment slot 72 in the arm 68 and carrying a nut 73 by which the shoulder 71 is clamped against the arm for retaining the gun assembly in any desired vertical adjustment. Rotary adjustment of the glue gun is adapted to be effected about the axis of the pin 69 and retained by means of a set screw 74. Horizontal adjustments of the gun assembly in each instance is adapted to be effected along a respective adjustment slot 75 in the horizontal bar of the bracket 65, and the selected horizontal adjustments maintained by means of bolts 77 (FIGS. 7 and 9). As a result, either or both of the glue guns and the associated separator finger 40 is adapted to be adjusted for any selected widths of sack blanks to be processed.

It will be understood that variations and modifications may be effected without departing from the spirit and scope of the novel concepts of this invention.

We claim as our invention:

1. In apparatus for making sacks having openable tops for access into the sacks, and each sack adapted to carry separable closure means across its top:

means for transporting along a given path sack blanks each having an expansion gusset on at least one side and with an end of the gusset adjacent to a bag top end of the sack blank;

and means located along said path for applying securing means selectively to said gusset end of each sack blank but leaving the remainder of the gusset of each sack blank freely expansible and leaving the openable top of each sack blank free for opening, and comprising means for spreading the gusset to facilitate application of adhesive to the inside of the gusset, an adhesive applicator selectively operable for applying respective spots of adhesive to limited portions at the inside walls of the gusset adjacent to said end and with the spot of adhesive on one wall being tansversely offset from the spot of adhesive on the other wall so that when the gusset walls are pressed back together the adhesive spots will engage adhesive-free areas of the respective opposing walls, and means downstream from said applicator for pressing the gusset walls together for assuring adhesion of the gusset walls to one another by means of the offset spots of adhesive.

2. An apparatus according to claim 1, wherein said sack blanks have gussets along opposite sides, and like means located along said path for applying securing means selectively to both gusset ends of each sack blank.

3. Apparatus according to claim 1, wherein said adhesive applicator comprises a multi-orifice nozzle for applying the adhesive in said spots within the gusset offset relative to one another across the width of the gusset.

4. Apparatus according to claim 1, wherein said means for applying securing means comprises a hot melt glue applicator, and means for controlling operation of the applicator to apply the glue spots spaced from one another transversely relative to the width of the gusset and of a limited length lengthwise of the gusset.

5. Apparatus according to claim 1, wherein said transporting means transports the blanks in a continuous collapsed tube form along said path, means for severing the continuous tube form into separate sack blanks, said applicator being located upstream from said severing means, said applicator comprising a nozzle, means for supplying adhesive to said nozzle, and means for controlling discharge of adhesive through said nozzle in timed coordinated relation with said severing means.

6. Apparatus according to claim 1, wherein said means for transporting includes a frame having portions along opposite sides of said path, a bracket extending between and supported under said path by and between said frame portions, and said applicator being carried on said bracket alongside said path.

7. Apparatus according to claim 6, wherein said applicator is supported by a member adjustable horizontally on said bracket toward and away from said path to accommodate sack blanks of selectively different widths, and means mounting said applicator on said member for vertical and rotary adjustments.

8. Apparatus for making sacks having openable tops for access into the sacks, and each sack adapted to carry separable closure means across its top, and comprising:

means for supplying and transporting along a working path a continuous tube length of collapsed sack blank material having a respective gusset along each opposite side and each gusset having walls collapsed upon themselves;

means for severing the collapsed sack tube material into predetermined sack lengths;

means located upstream from said severing means along said path for selectively applying adhesive for retaining sack top ends of said gussets closed, and comprising spreader fingers extending into the gussets and spreading the gusset walls apart for reception of adhesive to the walls inside of the gussets, and respective adhesive applicators selectively operable to apply adhesive at spots of limited width on said walls spaced transversely on one wall of the gussets in offset spaced relation to the spots on the other walls of the gussets and transversely relative to the width of the gussets and of limited length lengthwise of the gussets;

means downstream from said applicators for pressing the gusset walls together for assuring adhesion of the gusset walls to one another by means of the offset adhesive spots;

and means for operating said applicators in timed relation to said severing means.

9. Apparatus according to claim 8, wherein said means for transporting includes a frame having portions along opposite sides of said path, a bracket extending between and supported under said path by and between said frame portions, and said applicators being carried on said bracket along respective opposite sides of said path.

10. Apparatus according to claim 9, wherein said applicators are supported by respective members adjustable horizontally on said bracket toward and away from said path to accommodate sack blanks of selectively different widths, and means mounting said applicators on said members for vertical and rotary adjustments.

11. In a method of making sacks having openable tops for access into the sacks, and each sack adapted to carry separable closure means across its top:

transporting along a given path sack blanks each having an expansion gusset on at least one side and with an end of the gusset adjacent to a bag top end of the sack blank;

at a location along said path applying securing means selectively to said gusset end of each sack blank but leaving the remainder of the gusset of each sack blank freely expansible and leaving the openable top of each sack blank free for opening;

and said securing comprising spreading said gusset open, applying elongated spots of adhesive to opposite wall surfaces at the inside of the spread gusset, locating one of said spots of adhesive on one of the wall surfaces in transversely offset relation to another spot of adhesive on the other wall of the spread gusset, and downstream from said applying of the spots of adhesive squeezing said gusset closed for effecting adhesion of the walls to one another by means of said spots of adhesive.

12. A method according to claim 11, comprising providing said sack blanks with gussets along opposite sides, and at said location along said path applying the securing means selectively to both gusset ends of each sack blank.

13. A method according to claim 11, comprising applying the securing means as an adhesive selectively to limited portions of the inside of the gusset adjacent to said end.

14. A method according to claim 11, comprising applying the adhesive from a hot melt glue applicator.

15. A method according to claim 11, comprising transporting the blanks in a continuous collapsed tube form along said path, severing the continuous tube form into separate sack blanks, said location for applying securing means being upstream from said severing, said applying of the securing means comprising separating the gusset and applying the adhesive spots through an applicator nozzle, supplying adhesive to the nozzle, and controlling discharge of adhesive through said nozzle in timed coordinated relation with said severing.

* * * * * *